United States Patent [19]

Hughes

[11] Patent Number: 4,647,891

[45] Date of Patent: Mar. 3, 1987

[54] ENCAPSULATED MAGNET AND METHOD OF FORMING SAME

[76] Inventor: Richard E. Hughes, 821 Loma Dr., Hermosa Beach, Calif. 90254

[21] Appl. No.: 682,077

[22] Filed: Dec. 17, 1984

[51] Int. Cl.[4] ..... H01F 7/02

[52] U.S. Cl. ..... 335/302; 335/303; 29/607

[58] Field of Search ..... 335/302, 303, 306, 285, 335/295; 29/607

[56] References Cited

U.S. PATENT DOCUMENTS 3,546,643 12/1970 Virostek ..... 335/303

3,615,993 10/1971 French ..... 335/306

FOREIGN PATENT DOCUMENTS 200142 12/1938 Switzerland ..... 335/303

*Primary Examiner*—George Harris

*Attorney, Agent, or Firm*—Cislo, O'Reilly & Thomas

[57] ABSTRACT

An encapsulated magnet device which is made from bar stock having a hole drilled in, which receives a magnet, and thereafter the hole is plugged with a cap or plug of like material and subjected to a fusion process so that a magnetic device is obtained which is finely balanced and which is inert to the environment in which it is utilized. The method of fabricating the magnetic device of the invention comprises drilling out bar stock, inserting a magnet, closing the bore with a plug of like material, fusing the plug to the surrounding bar stock and thereafter milling or machining the encapsulated magnet member to the desired configuration.

10 Claims, 5 Drawing Figures

ENCAPSULATED MAGNET AND METHOD OF FORMING SAME

BRIEF SUMMARY OF THE INVENTION

The invention relates to encapsulated magnet devices that may be used as pistons or shuttles in valves or the like, and to other fields of use where it is desirable to isolate a magnetic member from the environment or atmosphere in which the magnet member is to be employed.

The invention is related to a magnetic device wherein it is critical to operation that the device be symmetrical and well balanced so that it may operate effectively in the field of use in which the magnetic member is to be employed and at the same time isolating the magnet member from the field of use in which it is to be used. In prior art devices, particularly of the type used in fluid or electrical switch environments, it is necessary to use a magnetic member which is well balanced and wherein the magnetic portion of the member is isolated from the environment or atmosphere in which the magnetic member is utilized.

Some prior art patents that employ magnetic members in pistons or shuttles where it may be desirable to have a well balanced member employing a magnetic portion which is isolated from the environment in which the device is used are Moore U.S. Pat. No. 4,081,635 entitled Electrical Switch Responsive to a Predetermined Fluid Flow; Pall U.S. Pat. No. 3,077,854 entitled Magnetic Pressure Indicator; Moore U.S. Pat. No. 2,892,051 entitled Flow Indicator; Caswell U.S. Pat. No. 3,057,977 entitled Flow Switches; and Aubert U.S. Pat. No. 3,200,214 entitled Flow Control Devices.

In the aforementioned U.S. patents, it will be seen that pistons or shuttle members are utilized for one reason or another and wherein it is desirable to have the piston or shuttle member employing a magnet therein which is balanced so as to operate in the mode in which it is intended. Where magnetic members are used in corrosive environments, such as to control acid flow and the like, it becomes necessary to isolate the magnet in an inert, synthetic material so as to not only protect the magnet from the corrosive environment but to protect the corrosive environment from the magnetic material. Of course, where the environment is not corrosive, it becomes important not to contaminate the environment with the magnetic material. Heretofore, the prior art has utilized various means of isolating the environment from the magnet material and vice versa without total success.

While the prior art has suggested molding inert synthetic material around a magnetic body, it has been difficult if not impossible to achieve exact symmetry because of the character of the molding process. That is, it has been difficult if not impossible to absolutely center a magnetic member within an encapsulating member so that the end product would be finely and truly balanced so that the same would operate in a smooth fashion in its intended environment.

The hereindisclosed invention overcomes the prior art difficulties alluded to hereinabove in that a piece of bar stock of inert synthetic material is provided with a central bore, and thereafter a magnetic member inserted therein in closely fitting relationship and a plug member used to close the bore which is then subsequently subjected to heat and pressure so that the plug fuses with the surrounding like material to totally encapsulate the magnetic member. Thereafter, the encapsulated magnetic member is machined so as to fulfill its ultimate function as a piston, shuttle, poppet or the like to be used in or out of corrosive environments, wherein the magnetic material is completely encapsulated and isolated from the atmosphere or environment in which the device is to be used.

It is an object of the invention to provide a totally encapsulated magnetic device which is finely balanced and a method of manufacturing same.

It is another object of the invention to provide an encapsulated magnetic device which is symmetrically configured and well balanced for use in corrosive and non-corrosive environments.

It is still a further important object of the invention to provide a magnetic device which is balanced and which employs a magnetic member totally encapsulated in an inert, synthetic surrounding body.

It is still a further more important object of the invention to provide an encapsulated magnetic device which is fabricated in a fascile mode not employing sophisticated, expensive technology.

It is still even further more specific important object of the invention to provide a method of making magnetic devices which are finely balanced and wherein the magnetic devices may be used in corrosive atmospheres or environments.

In an exemplary embodiment, the invention is directed to an encapsulated magnetic device comprising the combination of an inert, synthetic body member having selected material characteristics adapted for exposure to ambient environments without interaction therewith, wherein said body member has a central bore, having disposed therein a magnetic member. The central bore has a fused closure integral with the synthetic body member at one end thereof whereby the magnetic member is totally encapsulated within said synthetic body member.

The exemplary method of manufacturing the hereinbefore described magnetic device comprises taking a selected length of bar stock; forming therein a central bore; inserting a magnetic member of selected size to closely fit within said bore; taking a plug of like material to the bar stock synthetic material and inserting it in the open end of said bore; and subsequently subjecting the assemblage to conditions to cause fusion of the plug and surrounding material of the body member and thereafter machining the resultant body encapsulating the magnetic material into a selected configuration for use in corrosive and non-corrosive environments.

DESCRIPTION OF THE BEST EMBODIMENTS CONTEMPLATED

Figure 1:
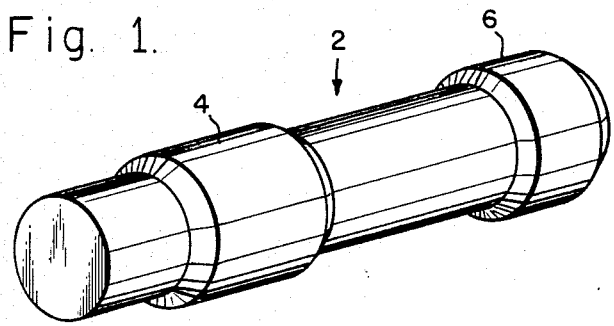
FIG. 1 is a perspective view of a magnetic device made in accordance with the invention.
Figure 2:
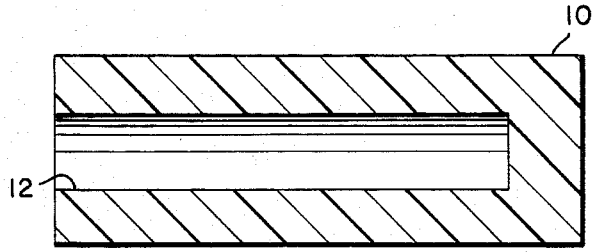
FIGS. 2, 3 and 4 are cross sectional views illustrating steps in the process of formation using the inventive method of the invention.
Figure 3:
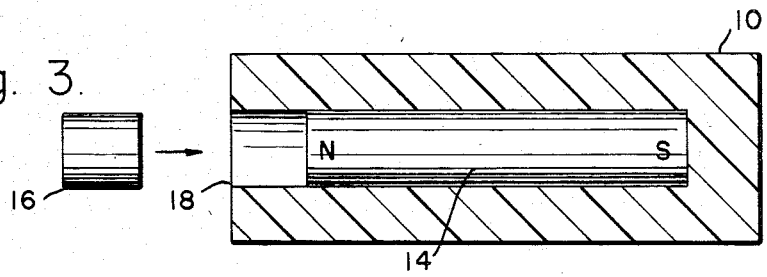
Figure 4:
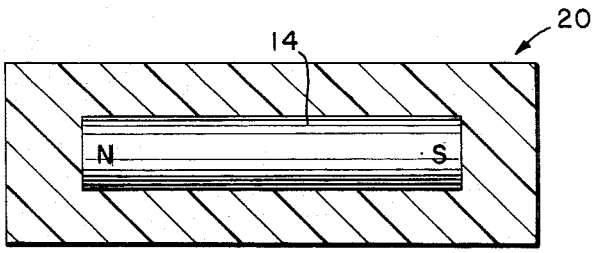

Referring to the drawings wherein like numerals of reference designate like elements throughout, it will be noted that the magnetic device 2 (best seen in FIGS. 1 and 5) comprises, in this particular instance, a cylindrical-like member having enlarged cylindrical portions such as 4 and 6 which have been machined from a completed assemblage which will be described as the disclosure proceeds herein. Suffice to say, that the magnetic device 2 carries a magnet 8 therein which magnet has been perfectly and centrally disposed within the device 2 in a manner to be described.

In the first step of manufacturing the device 2 of the invention, a piece of bar stock 10 of polyvinylidene fluoride (PVDF) also available from the Pennwalt Corp. under its trademark KYNAR may be utilized. Other materials of construction will be obvious to those in the art as the description proceeds herein, keeping in mind the end attributes to be obtained. The bar stock 10 in this instance is of cylindrical configuration but other configurations may be utilized.

The length of bar stock 10 has drilled therein a central bore 12 of a diameter and length sufficient to accommodate a magnet member to be disposed therein and which is again of sufficient size to be able to accomplish the end results which the device 2 is sought to accomplish. Those of ordinary skill in the art will at once recognize the relative dimensions, sizes, masses, etc. necessary to accomplish magnetically based functions, whether it be to control fluid flow as a valve or to act as a signal member to actuate an electrical circuit or the like.

The member 10 has inserted therein the magnet 14 in this instance taking the form of a cylinder which is of the selected mass as alluded to hereinbefore, and which is adapted to be closely received within the bore 12 and to be rigidly retained within the member 10 as will be described.

A plug 16 of like material to the bar stock used in fabrication of member 10 is inserted in the open end 18 of bore 12 in close fitting, snug relationship so as to abut against the end of magnet 14. Where the plug member 16 is of greater size in the axial direction, then the terminus of the bar stock member 10 it may be machined off at that time or at a subsequent time after the assemblage comprising the member 10 and the plug 16 with the magnet 14 disposed therein has been subjected to heat, pressure or other conditions so as to cause fusion of the plug member 16 with the surrounding portion of bar member 10 adjacent to bore 18.

The bar member 10 with the plug member 16 therein, retaining the magnet 14 in captive relationship, is subjected to, in this particular instance, a pressure molding procedure using conventional molding techniques and fixtures wherein a pressure in the range of 5–7 pounds per square inch is applied for 1–2 hours over a temperature range of 400–450 degrees F. or for such period as to cause fusion of the plug 16 with the surrounding material of bar stock 10.

Obviously, the materials of construction used for the device 2 will dictate times, pressures and temperatures, it only being important that the device 2 is fabricated using the hereindisclosed method so as to obtain total encapsulation of the magnet member, and wherein the device 2 is finely balanced.

Figure 5:
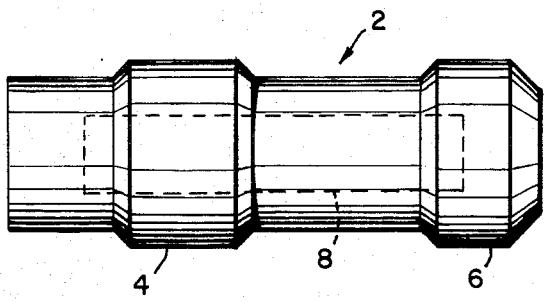
FIG. 5 is a side elevational view of one embodiment of the magnetic device made in accordance with the invention.

Thereafter, the completed assemblage 20, having the magnet 14 encapsulated by reason of the fusion process, is removed from the molding fixture and machined or otherwise worked upon to yield the exterior configuration as seen in FIG. 1 or 5 depending upon the end use to which the device 2 is to be put.

As indicated, other synthetic materials may be used, including for example Teflon, or such other synthetic materials as may be chosen, depending upon the end use to which an encapsulated magnet member may be put. Those of ordinary skill in the art will at once recognize various synthetic materials that will at once present themselves for utilization in the practice of the method of the invention to produce the device of the invention. It is only necessary that the synthetic materials be of a configuration, whether cylindrical bar stock or other polygonal bar stock, that will allow the formation of a central bore with accuracy necessary to obtain fine balancing, and to be able to receive a plug or cap of like material so as to permit fusion between the bar stock body and the plug or cap so as to totally encapsulate a magnet disposed within the bore.

The magnet devices of the invention, being fabricated of chemically inert material, may be used in association with corrosive and non-corrosive environments, fluids, atmospheres, and the materials of construction ideally should be those that may be readily machined to the ultimate configuration needed in the particular field of use.

The method of the invention was utilized to fabricate a device of the invention and the hereinfollowing example sets forth the procedures utilized:

Example 1

A capsule shell is created using $\frac{3}{8}''$ diameter bar stock of polyvinylidene fluoride by cutting the bar stock to length and drilling a center bore therein to act as a receptacle for a cylindrical magnet. The magnet was inserted and then a plug of polyvinylidene fluoride was inserted on top of the magnet in close fitting relationship. The assemblage was then placed in a compression molding fixture so as to exert a pressure of about 6 pounds per square inch on the assemblage, and thereafter the assemblage was subjected to a temperature of 410–430 degrees F. for about $1\frac{1}{2}$ hours.

The assemblage was then removed from the fixture in which it was subjected to the heat and pressure condition, and it was found that the plug or cap had melted and fused with the capsule shell, and upon cooling the assembly was then machined into the final configuration for its intended use.

While the invention has been described with specificity, those of ordinary skill in the art will at once recognize other alternatives and modifications, all of which will not depart from the spirit of the invention and all of which are intended to be covered by the appended claims.

Additionally, one of the important applications for the use of the invention is in high purity systems. That is, high purity systems require that immersed or in situ instrumentation not "out-gas", or otherwise impart impurities to the system in which it is immersed, even in the minutest parts conceivable, for example, parts per billion. This is particularly important in systems that are used in conjunction with chemical process analyzers or gas chromatographs. Additionally, the devices of the invention will find particular application in semi-conductor manufacturing operations such as vapor deposition, crystal growing, and doping. The devices of the invention also have applications involving high vacuum technology where high purity conditions must be maintained.

I claim:

1. An encapsulated magnet device comprising the combination:

an inert, synthetic body member having selected material characteristics adapted for exposure to ambient environments without interaction therewith, and having a central, linear, smooth surface bore within and terminating short and adjacent of the terminus of said body member, and having disposed therein a magnet member, said central bore having a fused closure integral with said synthetic body member at one end thereof whereby said magnetic member is totally encapsulated within said synthetic body member.

2. The device in accordance with claim 1 wherein the exterior surface of said body member is machined to a selected configuration.

3. The device in accordance with claim 2 wherein said central bore is symmetrical in axial and radial directions of said body member.

4. The device in accordance with claim 3 wherein said magnet member is centrally located so as to provide a balanced magnetic device.

5. The method of fabricating an encapsulated magnet comprising the steps of:

(a) cutting a bar stock of selected synthetic material to a selected length;

(b) forming a central bore in said bar stock to leave a closed end and an open end;

(c) inserting a magnet of selected size to fit within said central bore in close tolerance relationship therewith;

(d) placing a plug of like material in said central bore to completely fill the same and to snugly abut said magnet; and (e) subjecting the assemblage of step (d) to conditions to cause fusion of said plug and surrounding synthetic material and thereafter machining the assemblage to a selected exterior configuration.

6. The method in accordance with claim 5 wherein said synthetic material is adapted in relation to the environment to which the magnetic device is to be subjected.

7. The method in accordance with claim 6 wherein said synthetic material is polyvinylidene fluoride.

8. The method in accordance with claim 7 wherein said assemblage is subjected to heat and pressure in order to cause said fusion.

9. The method in accordance with claim 8 wherein said heat is in the range of 400–450 degrees F. at 5–7 pounds per square inch for 1–2 hours.

10. The method in accordance with claim 9 wherein the temperature is 410–430 degrees F. at 6 pounds per square inch.

* * * * *